United States Patent [19]

Prezas et al.

[11] Patent Number: 4,890,328

[45] Date of Patent: Dec. 26, 1989

[54] VOICE SYNTHESIS UTILIZING MULTI-LEVEL FILTER EXCITATION

[75] Inventors: Dimitrios P. Prezas, Park Ridge; David L. Thomson, Warrenville, both of Ill.

[73] Assignees: American Telephone and Telegraph Company, New York, N.Y.; AT&T Bell Laboratories, Murray Hill, N.J.

[21] Appl. No.: 770,631

[22] Filed: Aug. 28, 1985

[51] Int. Cl.[4] ..... G10L 7/02

[52] U.S. Cl. ..... 381/38; 381/36

[58] Field of Search ..... 381/36–41, 381/49, 29–35, 51–53; 369/513.5

[56] References Cited

U.S. PATENT DOCUMENTS

| | | | |
|---|---|---|---|
| 3,624,302 | 11/1971 | Atal | 381/40 |
| 3,852,535 | 12/1974 | Zurcher | 381/49 |
| 3,903,366 | 9/1975 | Coulter | 381/38 |
| 3,916,105 | 10/1975 | McCray | 381/41 |
| 3,979,557 | 9/1976 | Schulman et al. | 381/49 |
| 4,058,676 | 11/1977 | Wilkes et al. | 381/29 |
| 4,301,329 | 11/1981 | Taguchi | 381/37 |
| 4,360,708 | 11/1982 | Taguchi et al. | 381/36 |
| 4,472,832 | 9/1984 | Atal et al. | 381/40 |
| 4,561,102 | 12/1985 | Prezas | 381/49 |
| 4,618,982 | 10/1986 | Horvath et al. | 381/36 |
| 4,669,120 | 5/1987 | Ono | 381/40 |
| 4,696,038 | 9/1987 | Doddington et al. | 381/38 |
| 4,701,954 | 10/1987 | Atal | 381/49 |

OTHER PUBLICATIONS

"Improving Performance of Multipulse LPC Coders at Low Bit Rates", B. Atal, and S. Singhal, ICASSP '84, pp. 1.3–1.4.

"A New Model of LPC Excitation for Producing Natural-Sounding Speech at Low Bit Rates", B. Atal and J. Remde, ICASSP '82, pp. 614–617.

"An Integrated Pitch Tracking Algorithm for Speech Systems", B. G. Secrest and G. R. Doddington, in Proc. 1983 Int. *Conf. Acoust., Speech Signal Processing*, pp. 1352–1355, Apr. 1983.

"Postprocessing Techniques for Voice Pitch Trackers", B. G. Secrest and G. R. Doddington, in Proc. 1982 *IEEE Int. Conf. Acoust., Speech, Signal Processing*, pp. 172–175, Apr. 1982.

"A Processing for Using Pattern Classification Techniques to Obtain a Voiced/Unvoiced Classifier", L. J. Siegel, *IEEE Transactions on Acoustics, Speech and Signal Processing*, vol. ASSP-27, No. 1, pp. 83–89, Feb. 1979.

"Parallel Processing Techniques for Estimating Pitch Periods of Speech in the Time Domain", B. Gold and L. R. Rabiner, *The Journal of the Acoustical Society of America*, vol. 46, No. 2, pp. 442–448, 1969.

Araseki et al., "Multi-Pulse Excited Speech Coder Based on Maximum Cross-Correlation Search Algorithm", IEEE Globecom 83, pp. 23.2.1–23.3.5.

Copperi et al., "Vector Quantization and Peceptual Criteria for Low-Rate Coding of Speech", IEEE ICASSP 85, pp. 7.6.1–7.6.4.

Markel et al., "A Linear Prediction Vocoder Simulation Based on the Autocorrelation Method," IEEE Trans ASSP, vol. ASSP-22, No. 2, 4/74, pp. 124–134.

(List continued on next page.)

*Primary Examiner*—Gary V. Harkcom
*Assistant Examiner*—John A. Merecki
*Attorney, Agent, or Firm*—John C. Moran

[57] ABSTRACT

A speech analysis and synthesis system where pitch information for excitation is transmitted during voice segments of speech and pulse excitation or noise excitation is transmitted during unvoiced speech segments along with linear predictive coding (LPC) parameters. The decision of whether to transmit noise excitation or pulse excitation is performed by comparing the variance of the residual to the square of the mean amplitude of the rectified residual for each frame. If the result of this comparison is greater than a threshold value, pulse excitation is utilized otherwise noise excitation is used. The pulse excitation comprises a subset of samples of the LPC residual as determined by the relative amplitudes and spacing of the local maxima in the LPC residual.

24 Claims, 13 Drawing Sheets

OTHER PUBLICATIONS

Malpass, "The Gold-Rabiner Pitch Detector in a Real Time Environment", EASCON 75, pp. 31-A-31-G.

Un et al., "A Pitch Extraction Algorithm Based on LPC Inverse Filtering and AMDF", IEEE Trans. ASSP, vol. ASSP-25, No. 65, 12/77, pp. 565-572.

Wong, "On Understanding the Quality Problems of LPC Speech", IEEE ICASSP 80, pp. 725-728.

Alexander, "A Simple Noniterative Speech Excitation Algorithm Using the LPC Residual", IEEE Trans. ASSP, vol. ASSP-33, No. 2, 4/85, pp. 432-434.

Holm, "Automatic Generation of Mixed Excitation in a Linear Predictive Speech Synthesizer", IEEE ICASSP 81, pp. 118-120.

Makhoul et al., "A Mixed-Source Model for Speech Compression and Synthesis", J. Acoust. Soc. Am., vol. 64, No. 6, Dec. 1987, pp. 1577-1581.

Un et al., "A 4800 BPS LPC Vocoder with Improved Excitation", IEEE ICASSP 80, 9-11, Apr. 1980, pp. 142-145.

VOICED PACKET

UNVOICED WITH WHITE NOISE EXCITATION PACKET

UNVOICED WITH PULSE EXCITATION PACKET

VOICE SYNTHESIS UTILIZING MULTI-LEVEL FILTER EXCITATION

CROSS-REFERENCE TO RELATED APPLICATIONS

Concurrently filed herewith and assigned to the same assignee as this application are:

J. Picone, et al., "A Parallel Processing Pitch Detector", Ser. No. 770,630; and W. T. Hartwell, et al., "Digital Speech Coder With Different Excitation Types", Ser. No. 770,632.

MICROFICHE APPENDICES

Included in this application are Microfiche Appendices A and B. The total number of microfiche is 26 sheets and the total number of frames is 1.

TECHNICAL FIELD

This invention relates to digital coding of human speech signals for compact storage or transmission and subsequent synthesis and, more particularly, to the type of signal utilized in a synthesizer to excite a synthesis filter to produce a replica of the human speech.

BACKGROUND OF THE INVENTION

In order to store or transmit voice at low bit rates, it is known to digitize the human speech and then to encode the speech so as to minimize the number of digital bits per second required to represent the speech. The analog speech samples are customarily portioned into frames or segments of discrete length on the order of 20 milliseconds in duration. Sampling is typically performed at a rate of 8 kilohertz (kHz) and each sample is encoded into a multi-bit digital number. Successive coded samples are further processed in a linear predictive coder (LPC) that determines appropriate filter coefficients/parameters that model the human vocal tract. The filter parameters can be used to estimate present values of each signal sample efficiently on the basis of the weighted sum of a preselected number of prior sampled values. The filter parameters model the formant structure of the vocal tract transfer function. The speech signal is regarded analytically as being composed of an excitation signal and a formant transfer function. The excitation component arises in the larynx or voice box and the formant component results from the operation of the remainder of the vocal tract on the excitation component. The excitation component is further classified as voiced or unvoiced, depending upon whether or not there is a fundamental frequency imparted to the air stream by the vocal cords. If there is a fundamental frequency imparted to the air stream by the vocal cords, then the excitation component is classified as voiced. If the excitation is unvoiced, then the excitation component is simply classified as white noise in the prior art. To encode speech for low bit rate transmission, it is necessary to determine the LPC coefficients for the segments of speech and transfer these coefficients to the decoding circuit that is to reproduce the speech. In addition, it is necessary to determine the excitation component and to transfer this component to the decoding circuit, or as it is also commonly called, a synthesizer.

One method for determining the excitation to be utilized in the synthesizer is the multi-pulse excitation model that is described in U.S. Pat. No. 4,472,832, issued on Sept. 18, 1984, to B. S. Atal, et al. This method functions by determining a number of pulses for each frame which are then used by the synthesizer to excite the formant filter. These pulses are determined by an analysis by synthesis method as is described in the previously cited paper. Whereas the multi-pulse excitation model performs well at bit rates at 9.6 Kbs, and above the quality of speech synthesis starts to degrade at lower bit rates. In addition, during the voiced regions of the speech, the synthesized speech can be slightly rough and not true to the original speech. Another problem that exists with the multi-pulse excitation model is the large amount of computation required to determine the pulses for each frame since the calculation of the pulses requires a number of complex mathematical operations.

Another method utilized for determining the excitation for LPC synthesized speech is to determine the pitch or fundamental frequency being generated by the larynx during the voiced regions. The synthesizer, upon receiving the pitch, then generates the corresponding frequency to excite the formant filter. During the periods when the speech is considered to be unvoiced, this fact is transmitted to the synthesizer, and the synthesizer utilizes a white noise generator to excite the formant filter. A problem with this method is that the white noise excitation is an inadequate excitation for plosive consonants, transitions between voiced and unvoiced speech frame sequences, and voiced frames which are erroneously declared unvoiced. This problem results in the synthesized speech not sounding the same as the original speech.

In view of the above, there exists a need for an excitation model that can accurately model both the voiced and unvoiced regions of speech and properly handle the transitional areas between unvoiced and voiced frame sequences as well as reproduce the plosive consonants.

SUMMARY OF THE INVENTION

The above-mentioned problems are solved and a technical advance is achieved in accordance with the principles of this invention in an illustrative structural embodiment and method wherein excitation utilized to excite a filter modeling the vocal tract utilizes the fundamental frequency during voiced segments of speech and utilizes white noise excitation during noise segments of speech and utilizes pulses that are computed in an economically efficient manner during the segments that are neither voiced nor noise. An excitation model determines when to utilize the noise or pulse excitation based on a threshold that is linked to the variance of the residual signals of the speech samples with respect to the mean amplitude of the rectified residual signals.

The structural embodiment comprises a sample and quantizer circuit that is responsive to human speech to digitize and quantize the speech into a plurality of speech frames. A parameter unit is used to calculate a set of speech parameters defining the vocal tract for each speech frame and another unit is used to designate which of those frames are voiced and which are unvoiced. For each frame, a pitch detection unit is used to determine the pitch for each of the frames and another excitation unit produces a plurality of other types of excitation information. A channel encoder/combining unit is responsive to frames that have been designated as voiced to combine the pitch information with the set of speech parameters for communication and is responsive to frames that have been designated as unvoiced to combine one of the other types of excitation information with the set of speech parameters for communication.

Advantageously, the other excitation unit produces either pulse type excitation or designates that noise type excitation is to be utilized in the synthesizer. The pulse type excitation is generated by calculating residual samples from the speech samples for each frame and determining a subset of maximum pulses from these residual samples. This subset of pulses represents the pulse type excitation that is communicated as one of the excitation types by the channel encoder.

Advantageously, the system selects whether to use noise type excitation or pulse type excitation by calculating the variance of the residual samples and the mean amplitude of the rectified residual samples for each frame. A comparison is then made between the variance of the residual and the square of the mean amplitude of the rectified residual. Pulse type excitation information is designated to be selected if the comparison of the variance to the square of the mean amplitude is greater than a predetermined threshold.

Also, the set of speech parameters is obtained by calculating a set of linear predictive coding parameters for each of the frames. In addition, the pitch for each frame is generated by a plurality of identical pitch detectors each responsive to an individual predetermined portion of the speech samples for each frame to estimate individual pitch values. A voter unit is responsive to the individually estimated pitch values from each of the pitch detectors for determining a final pitch value for each of the frames.

Advantageously, the structural embodiment includes a synthesizer subsystem that has a unit for receiving the communicated excitation information and the speech parameters for each of the frames. The synthesizer subsystem is responsive to each frame that contains pitch information for utilizing the latter information to excite a synthesis filter based on the speech parameters for that frame. If the excitation information is pulse type excitation, then the pulses communicated with the speech parameters are used to excite the synthesis filter. If noise type excitation is designated, then a noise generator is used within the synthesis subsystem to generate noise type excitation to drive the synthesis filter.

Advantageously, the previously detailed functions may be performed by a digital signal processor executing sets of program instructions with the sets being further subdivided into subsets and groups of instructions that control the execution of the digital signal processor.

The illustrative method functions in a system having a quantizer and a digitizer for converting analog speech into frames of digital samples and the method performs the steps of storing a plurality of speech frames each having a predetermined number of the digital samples, calculating a set of speech parameters defining the vocal tract for each frame, designating each frame as voiced or unvoiced, generating pitch type excitation information for each frame, producing a plurality of other types of excitation information for each frame, and combining the pitch excitation information with the speech parameters when a frame is designated as voiced and combining the speech parameters with one of other excitation types when the frame is designated as unvoiced.

Also, the step of producing the other types of excitation information includes generating pulse type excitation information by performing the steps of calculating residual samples for each frame from the digital speech samples, determining pulses from the residual samples with the resulting pulses being the pulse type excitation information. Further, the pulses are determined from the residual samples by locating a subset of the pulses within the residual samples for each frame that have maximum amplitudes.

Advantageously, the combining step includes selecting one of other types of excitation by calculating the variance of the residual samples and the mean amplitude of the rectified residual samples for each frame, comparing the calculated variance with the square of the calculated mean amplitude, and selecting pulse type excitation if the comparison result is greater than a predetermined threshold.

DETAILED DESCRIPTION

Figure 1:
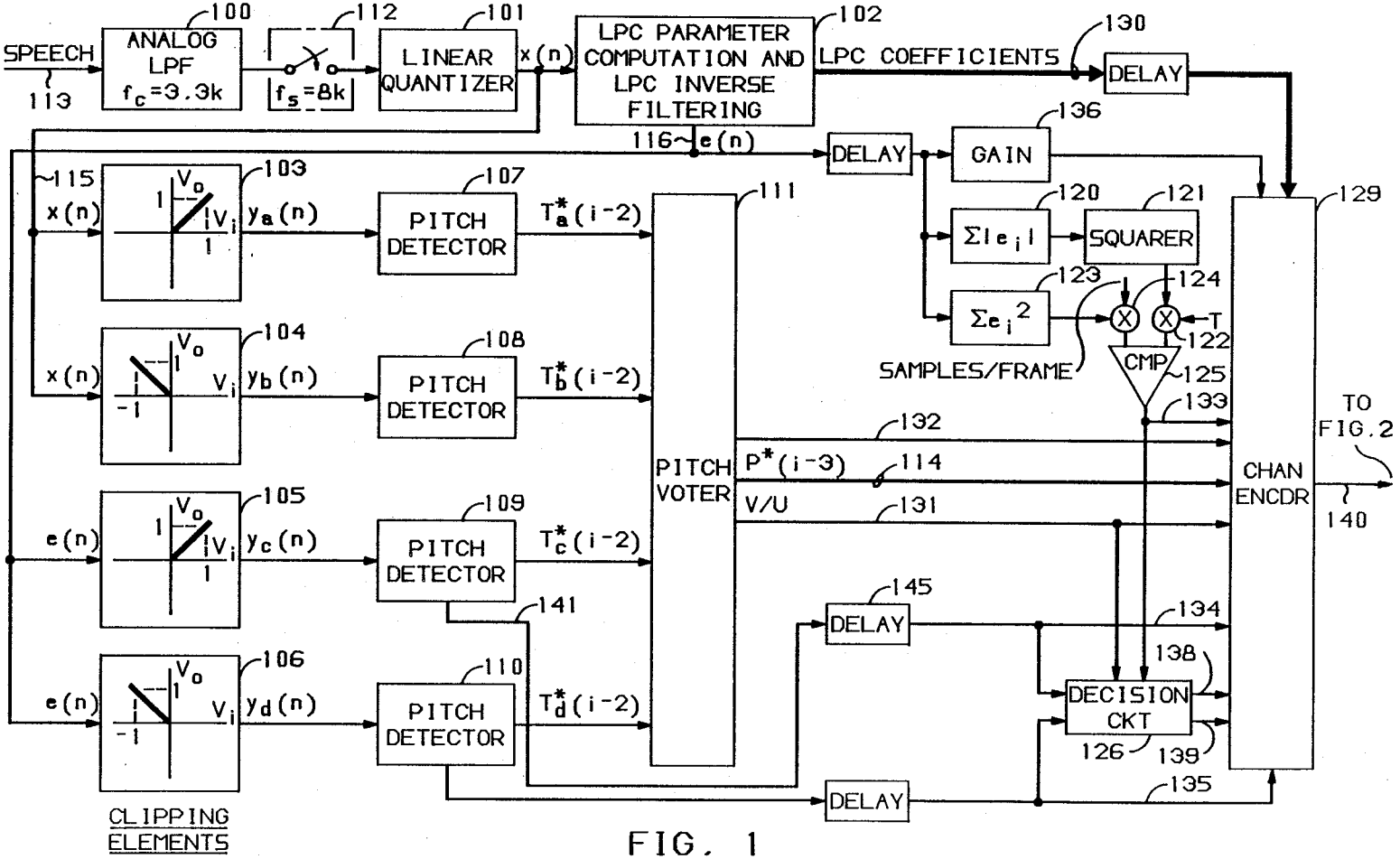
FIG. 1 illustrates, in block diagram form, a voice analyzer in accordance with this invention.
Figure 2:
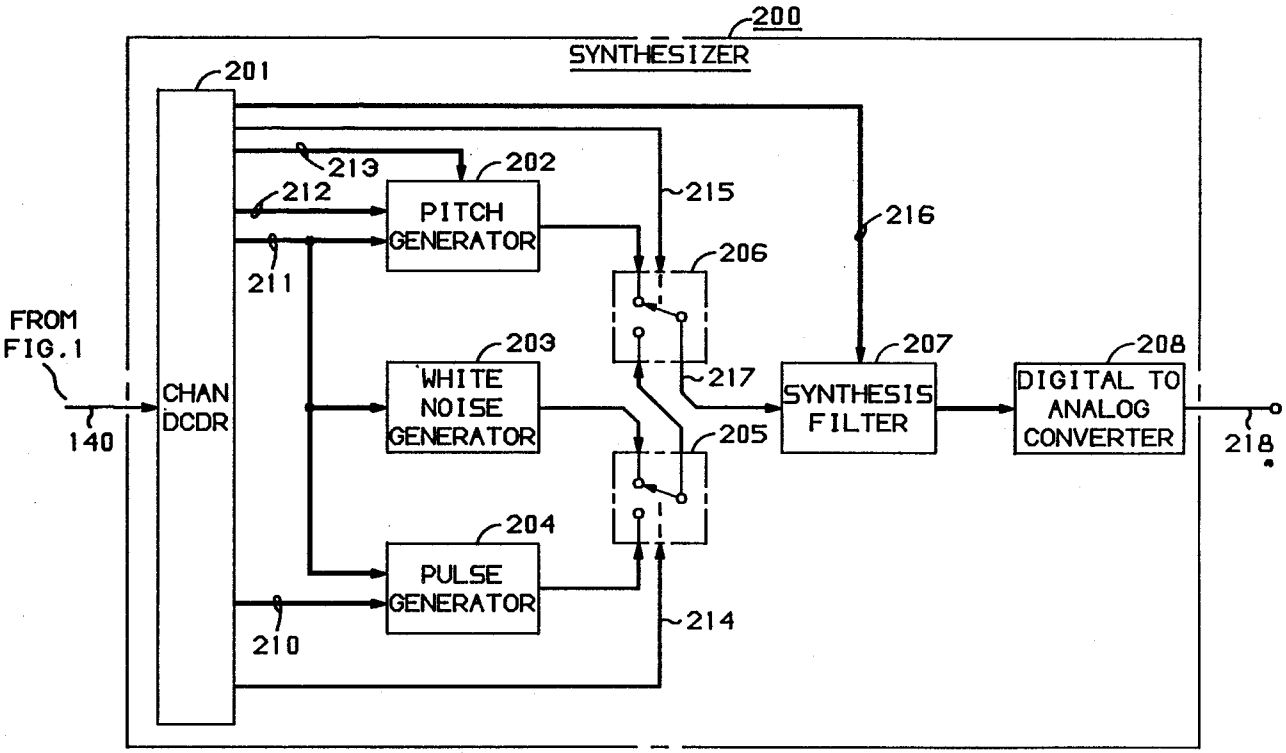
FIG. 2 illustrates, in block diagram form, a voice synthesizer in accordance with this invention.
Figure 3:
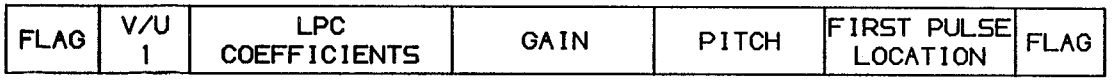
FIG. 3 illustrates a packet containing information for replicating voiced speech.
Figure 4:
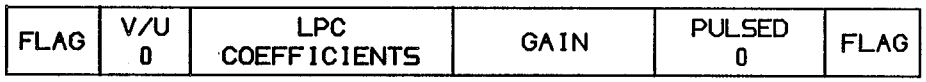
FIG. 4 illustrates a packet containing information for replicating unvoiced speech utilizing noise excitation.
Figure 5:
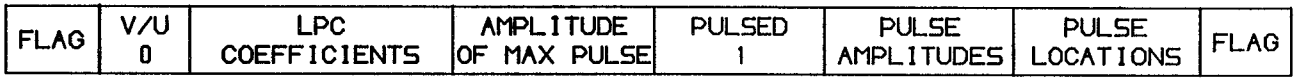
FIG. 5 illustrates a packet containing information for replicating unvoiced speech utilizing pulse excitation.

FIGS. 1 and 2 illustrate a speech analyzer and speech synthesizer, respectively, which are the focus of this invention. The speech analyzer of FIG. 1 is responsive to analog speech signals received via conductor 113 to encode these signals at a low bit rate for transmission to synthesizer 200 of FIG. 2 via channel 140. Advantageously, channel 140 may be a communication transmission path or may be storage so that voice synthesis may be provided for various applications requiring synthesized voice at a later point in time. One such application is speech output from a digital computer. The analyzer illustrated in FIG. 1 digitizes and quantizes the analog speech information utilizing blocks 100, 112, and 101. Block 102 is responsive to the quantized digitized samples to produce the linear predictive coded (LPC) coefficients that model the human vocal tract. The formation of these latter coefficients may be performed according to the arrangement disclosed in U.S. Pat. No. 3,740,476, issued to B. S. Atal, June 19, 1973, and assigned to the same assignee as this application or in any other arrangements well known in the art. With the exception of channel encoder 129, the remaining elements of FIG. 1 are utilized to determine the excitation used in synthesizer 200 of FIG. 2 to excite the model defined by the LPC filter coefficients. Channel encoder 129 is responsive to the LPC coefficients and the information defining the excitation to transmit this information to synthesizer 200 in the form of packets as illustrated in FIGS. 3 through 5. The latter figures illustrate the information being transmitted in the form of packets, however, it would be obvious to one skilled in the art that this information could be stored in memory for later use by the synthesizer also or that is information could be transmitted in parallel to the synthesizer. The transmission of the LPC coefficients and the excitation component is performed on a per-frame-basis with a frame advantageously consisting of 160 samples. The excitation component can either be the pitch defining the fundamental frequency being imparted to the speech by the larynx, a designation that the synthesizer is to use a white noise generator, or a set of residual samples as determined by pitch detectors 109 and/or 110.

The decision on which type of excitation to transmit is performed by blocks 111, 125, and 126 in the following manner. Pitch detectors 109 and 110 are responsive to the residual signals, e(n), from block 102 to indicate to pitch voter 111 whether the signals are voiced or unvoiced; and blocks 107 and 108 are responsive to the digitized speech samples, x(n), to make a determination whether these signals are voiced or unvoiced. Pitch voter 111 makes a final determination of whether to indicate that a frame is voiced or unvoiced. If pitch voter 111 determines that the frame is voiced, a signal is transmitted to channel encoder 129 via path 131 indicating this fact. Channel encoder 129 is responsive to this indication to form the packet illustrated in FIG. 3. The latter packet includes the LPC coefficients, the indication that the frame is voiced, the pitch information from pitch voter 111, the gain information from gain calculator 136, and the location of the first pulse if the first frame of a voiced sequence is being processed from pitch voter 111 via path 132.

If pitch voter 111 determines that the frame is unvoiced, it transmits a signal to element 126 and channel encoder 129 via path 131 to this effect. The decision must be made in the analyzer of FIG. 1 whether or not to transmit an indication for the synthesizer to use white noise or to transmit the pulses determined by pitch detectors 109 or 110 to the synthesizer. The latter determination is performed in the following manner. If the following condition is met, $$\frac{\text{variance of residual}}{(\text{mean amplitude of rectified residual})^2} \leqq T \qquad (1)$$

where $$\text{variance of residual} = \frac{\sum_n e_n^2}{N}$$

$$\text{mean amplitude of rectified residual} = \frac{\sum_n |e_n|}{N}$$

then the excitation should be white noise in the synthesizer. If the above condition is not met, then pulse excitation should be transmitted to synthesizer 200. Equation 1 can be rewritten as:

$$N \sum_n e_n^2 \leqq T \left| \sum_n |e_n| \right|^2 \qquad (2)$$

Advantageously, in the above equations, N is 160 which is the number of samples per frame, and T has an approximate value of 1.8. The right hand portion of equation 2 is calculated by blocks 120 through 122 of FIG. 1 and the left hand portion is calculated by blocks 123 and 124. Comparator 125 is responsive to the outputs of multipliers 122 and 124 to evaluate equation 2. This evaluation from comparator 125 is transmitted via path 133 to channel encoder 129 and decision circuit 126. If comparator 125 indicates that the output of multiplier 124 is less than or equal to the output of multiplier 122, comparator 125 transmits a signal via path 133 indicating that white noise excitation is to be used in the synthesizer. Channel encoder 129 is responsive to the latter signal to form the packet indicated in FIG. 4. This packet has the v/u bit set equal to "0" indicating an unvoiced frame, the pulsed bit set equal to a "0" indicating that white noise excitation should be used, the gain from gain block 136, and the LPC coefficients from block 102.

If comparator 125 determines that the output of multiplier 124 is greater than the output of multiplier 122, comparator 125 transmits a signal via path 133 indicating that pulses should be used for the excitation. For the current frame and in response to the latter signal, decision circuit 126 determines whether to transmit all of the candidate pulses from pitch detectors 109 and 110 or to transmit only one set of these pulses. If the total number of candidate pulses from both pitch detectors is less than or equal to 7, decision circuit 126 transmits to channel encoder 129 a "1" via path 138. Channel encoder 129 is responsive to the signal from comparator 125 and the "1" from decision circuit 126 to utilize all of the candidate pulses being transmitted via paths 134 and 135 to form the packet illustrated in FIG. 5. If the total number of maximum pulses from pitch detectors 109 and 110 is greater than 7, decision circuit 126 transmits a "0" via path 138 to channel encoder 129 and indicates to channel encoder 129 via path 139 whether the channel encoder is to utilize the pulses on path 134 or 135. This determination is made on the basis of which pitch detector has the largest pulse for the present frame. If pitch detector 109 has produced the largest pulse, then decision circuit 126 transmits a "1" to channel encoder 129. However, if pitch detector 110 has produced the largest pulse, then decision circuit 126 transmits a "0" to channel encoder 129. The latter is responsive to the "0" received via path 138 and the signal received via path 139 to select the indicated set of pulses from paths 133 or 134 and to form the packet illustrated in FIG. 5. The latter packet has the v/u bit set equal to a "0" indicating an unvoiced frame, the pulse bit set equal to a "1", indicating that pulse excitation is to be utilized and contains the location of the pulses and their amplitude as well as the LPC coefficients.

Synthesizer 200, as illustrated in FIG. 2, is responsive to the voice tract model and excitation information received via channel 140 to reproduce the original analog speech that has been encoded by the analyzer of FIG. 1. Synthesizer 200 functions in the following manner. Upon receipt of a voiced information packet, as illustrated in FIG. 3, channel decoder 201 transfers the LPC coefficients to synthesis filter 207 via path 216, transfers the pitch information via path 212, and the power level via path 211 to pitch generator 202. In addition, if it is the first voiced frame of a voiced sequence, channel decoder transmits the starting position of the first pulse via path 213 to pitch generator 202. If v/u bit equals a "1" indicating a voiced frame, channel decoder conditions selector 206 to select the output of pitch generator 202 and causes this information from pitch generator 202 to be communicated to synthesis filter 207 via path 217. Pitch generator 202 is responsive to the information received via paths 211 through 213 to regenerate the fundamental frequency that has been generated by the larynx during the actual speech. Synthesis filter 207 is responsive to the LPC coefficients that define the voice tract model and the excitation received from pitch generator 202 to produce digital samples that represent the speech. Digital-to-analog converter 208 is responsive to these digital samples produced by filter 207 to produce an analog representation of the speech on conductor 218.

If channel decoder 201 receives an unvoiced with noise excitation packet such as illustrated in FIG. 4, channel decoder 201 transmits a signal via path 214 causing selector 205 to select the output of white noise generator 203 and channel decoder 201 transmits a signal via path 215 causing selector 206 to select the output of selector 205. In addition, channel decoder 201 transmits the power factor to white noise generator 203. Synthesis filter 207 is responsive to the LPC coefficients received from channel decoder 201 via path 216 and the output of white noise generator 203 received via selectors 205 and 206 to produce digital samples of the speech.

If channel decoder 201 receives from channel 140 an unvoiced frame with pulse excitation, as illustrated in FIG. 5, the latter decoder transmits the location and relative amplitudes of the pulses with respect to the amplitude of the largest pulse to pulse generator 204 via path 210 and the amplitude of the largest pulse via path 211. In addition, channel decoder 201 conditions selectors 205 and 206 via paths 214 and 215, respectively, to select the output of pulse generator 204 and transfer this output to synthesis filter 207. Synthesis filter 207 and digital-to-analog converter 208 then reproduce the speech. Converter 208 has a self-contained low-pass filter at the output of the converter. In addition, channel decoder 201 transmits via path 216 the LPC coefficients to synthesis filter 207 that is described in U.S. Pat. No. 3,740,476, issued to B. S. Atal, June 19, 1973, and assigned to same assignee as in other arrangements well known in the art.

Consider now in greater detail, how the pitch detection function is performed as illustrated in FIG. 1. The clippers 103 through 106 transform the incoming x and e digitized signals on paths 115 and 116, respectively, into positive-going and negative-going wave forms. The purpose for forming these signals is that whereas the composite waveform might not clearly indicate periodicity the clipped signal might. Hence, the periodicity is easier to detect. Clippers 103 and 105 transform the x and e signals respectively, into positive-going signals and clippers 104 and 106 transform the x and e signals, respectively, into negative-going signals.

Pitch detectors 107 through 110 are each responsive to their own individual input signals to make a determination of the periodicity of the incoming signal. The output of the pitch detectors is two frames after receipt of those signals. Note, that each frame consists of, illustratively, 160 sample points. Pitch voter 111 is responsive to the output of the four pitch detectors to make a determination of the final pitch. The output of pitch voter 111 is transmitted via path 114.

Figure 6:
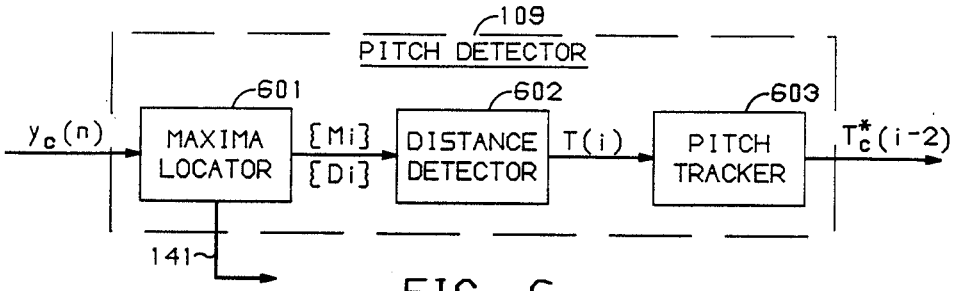
FIG. 6 illustrates, in block diagram form, pitch detector 109 of FIG. 1.

FIG. 6 illustrates in block diagram form, pitch detector 109. The other pitch detectors are similar in design. The maxima locator 601 is responsive to the digitized signals of each frame for finding the pulses on which the periodicity check is performed. The output of maxima locator 601 is two sets of numbers: those representing the maximum amplitudes, $M_i$, which are the candidate samples, and those representing the location within the frame of these amplitudes, $D_i$. These two sets of numbers are also transferred to delay 145 for possible use as excitation pulses if pitch voter 111 determines the present frame to be unvoiced. Distance detector 602 is responsive to these two sets of numbers to determine a subset of candidate pulses that are periodic. This subset represents distance detector 602's determination of what the periodicity is for this frame. The output of distance detector 602 is transferred to pitch tracker 603. The purpose of pitch tracker 603 is to constrain the pitch detector's determination of the pitch between successive frames of digitized signals. In order to perform this function, pitch tracker 603 uses the pitch as determined for the two previous frames.

Consider now in greater detail, the operations performed by maxima locator 601. Maxima locator 601 first identifies within the samples from the frame, the global maxima amplitude, $M_0$, and its location, $D_0$, in the frame. The other points selected for the periodicity check must satisfy all of the following conditions. First, the pulses must be a local maxima, which means that the next pulse picked must be the maximum amplitude in the frame excluding all pulses that have already been picked or eliminated. This condition is applied since it is assumed that pitch pulses usually have higher amplitudes than other samples in a frame. Second, the amplitude of the pulse selected must be greater than or equal to a certain percentage of the global maximum, $Mi > gM_0$, where g is a threshold amplitude percentage that, advantageously, may be 25%. Third, the pulse must be advantageously separated by at least 18 samples from all the pulses that have already been located. This condition is based on the assumption that the highest pitch encountered in human speech is approximately 444 Hz which at a sample rate of 8 kHz results in 18 samples.

Distance detector 602 operates in a recursive-type procedure that begins by considering the distance from the frame global maximum, $M_0$, to the closest adjacent candidate pulse. This distance is called a candidate distance, $d_c$, and is given by $$d_c = |D_0 - D_i|$$

where $D_i$ is the in-frame location of the closest adjacent candidate pulse. If such a subset of pulses in the frame are not separated by this distance, plus or minus a breathing space, B, then this candidate distance is discarded, and the process begins again with the next closest adjacent candidate pulse using a new candidate distance. Advantageously, B may have a value between 4 to 7. This new candidate distance is the distance to the next adjacent pulse o the global maximum pulse.

Figure 7:
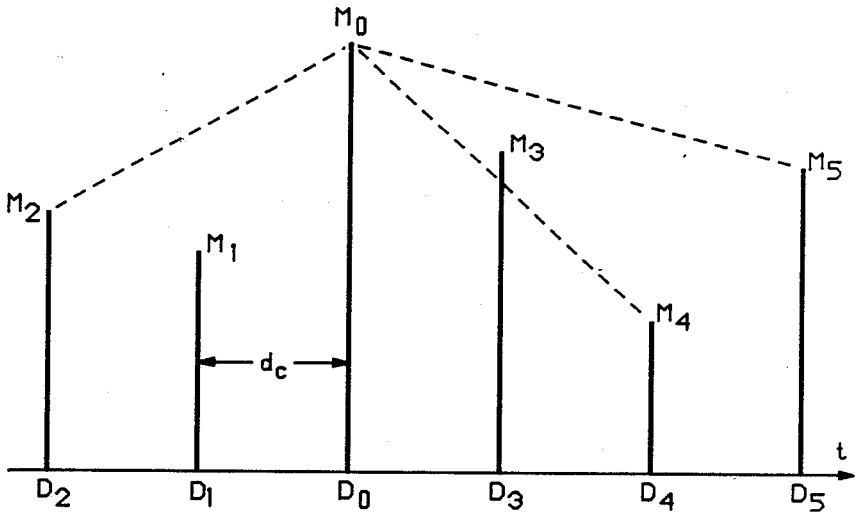
FIG. 7 illustrates, in graphic form, the candidate samples of a speech frame.

Once pitch detector 602 has determined a subset of candidate pulses separated by a distance, $d_c \pm B$, an interpolation amplitude test is applied. The interpolation amplitude test performs linear interpolation between $M_0$ and each of the next adjacent candidate pulses, and requires that the amplitude of the candidate pulse immediately adjacent to $M_0$ is at least q percent of these interpolated values. Advantageously, the interpolation amplitude threshold, q percent, is 75%. Consider the example illustrated by the candidate pulses shown in FIG. 7. For $d_c$ to be a valid candidate distance, the following must be true:

$$M_1 > q\left[M_2 + \frac{M_0 - M_2}{|D_0 - D_2|}|D_1 - D_2|\right],$$

$$M_3 > q\left[M_4 + \frac{M_0 - M_4}{|D_0 - D_4|}|D_3 - D_4|\right],$$

and $$M_3 > q\left[M_5 + \frac{M_0 - M_5}{|D_0 - D_5|}|D_3 - D_5|\right],$$

where $$d_c = |D_0 - D_1| > 18.$$

As noted previously, $$M_i > gM_0, \text{ for } i = 1,2,3,4,5.$$

Pitch tracker 603 is responsive to the output of distance detector 602 to evaluate the pitch distance estimate which relates to the frequency of the pitch since the pitch distance represents the period of the pitch. Pitch tracker 603's function is to constrain the pitch distance estimates to be consistent from frame to frame by modifying, if necessary, any initial pitch distance estimates received from the pitch detector by performing four tests: voice segment start-up test, maximum breathing and pitch doubling test, limiting test, and abrupt change test. The first of these tests, the voice segment start-up test is performed to assure the pitch distance consistency at the start of a voiced region. Since this test is only concerned with the start of the voiced region, it assumes that the present frame has non-zero pitch period. The assumption is that the preceding frame and the present frame are the first and second voice frames in a voiced region. If the pitch distance estimate is designated by T(i) where i designates the present pitch distance estimate from distance detector 602, the pitch detector 603 outputs T*(i-2) since there is a delay of two frames through each detector. The test is only performed if T(i-3) and T(i-2) are zero or if T(i-3) and T(i-4) are zero while T(i-2) is non-zero, implying that frames i-2 and i-1 are the first and second voiced frames, respectively, in a voiced region. The voice segment start-up test performs two consistency tests: one for the first voiced frame, T(i-2), and the other for the second voiced frame, T(i-1). These two tests are performed during successive frames. The purpose of the voice segment test is to reduce the probability of defining the start-up of a voiced region when such a region is not actually begun. This is important since the only other consistency tests for the voice regions are performed in the maximum breathing and pitch doubling tests and there only one consistency condition is required. The first consistency test is performed to assure that the distance of the right candidate sample in T(i-2) and the most left candidate sample in T(i-1) and T(i-2) are close to within a pitch threshold B+2.

If the first consistency test is met, then the second consistency test is performed during the next frame to ensure exactly the same result that the first consistency test ensured but now the frame sequence has been shifted by one to the right in the sequence of frames. If the second consistency test is not met, then T(i-1) is set to zero, implying that frame i-1 can not be the second voiced frame (if T(i-2) was not set to zero). However, if both of the consistency tests are passed, then frames i-2 and i-1 define a start-up of a voiced region. If T(i-1) is set to zero, while T(i-2) was determined to be non-zero and T(i-3) is zero, which indicates that frame i-2 is voiced between to unvoiced frames, the abrupt change test takes care of this situation and this particular test is described later.

The maximum breathing and pitch doubling test assures pitch consistency over two adjacent voiced frames in a voiced region. Hence, this test is performed only if T(i-3), T(i-2), and T(i-1) are non-zero. The maximum breathing and pitch doubling tests also checks and corrects any pitch doubling errors made by the distance detector 602. The pitch doubling portion of the check checks if T(i-2) and T(i-1) are consistent or if T(i-2) is consistent with twice T(i-1), implying a pitch doubling error. This test first checks to see if the maximum breathing portion of the test is met, that is done by $$|T(i\text{-}2) - T(i\text{-}1)| \leqq A,$$

where A may advantageously have the value 10. If the above equation is met, then T(i-1) is a good estimate of the pitch distance and need not be modified. However, if the maximum breathing portion of the test fails, then the test must be performed to determine if the pitch doubling portion of the test is met. The first part of the test checks to see if T(i-2) and twice T(i-1) are close to within a pitch threshold as defined by the following, given that T(i-3) is non-zero, $$|T(i-2) - 2T(i-1)| \leqq \frac{T(i-1)}{2}.$$

If the above condition is met, then T(i-1) is set equal to T(i-2). If the above condition is not met, then T(i-1) is set equal to zero. The second part of this portion of the test is performed if T(9-3) is equal to zero. If the following are met $$|T(i\text{-}2) - 2T(i\text{-}1)| \leqq B$$

and $$|T(i\text{-}1) - T(i)| > A$$

then $$T(i\text{-}1) = T(i\text{-}2).$$

If the above conditions are not met, T(i-1) is set equal to zero.

The limiting test which is performed on T(i-1) assures that the pitch that has been calculated is within the range of human speech which is 50 Hz to 400 Hz. If the calculated pitch does not fall within this range, then T(i-1) is set equal to zero indicating that frame i-1 cannot be voiced with the calculated pitch.

The abrupt change test is performed after the three previous tests have been performed and is intended to determine that the other tests may have allowed a frame to be designated as voiced in the middle of an unvoiced region or unvoiced in the middle of a voiced region. Since humans usually cannot produce such sequences of speech frames, the abrupt change test assures that any voiced or unvoiced segments are at least two frames long by eliminating any sequence that is voiced-unvoiced-voiced or unvoiced-voiced-unvoiced. The abrupt change test consists of two separate procedures each designed to detect the two previously mentioned sequences. Once pitch tracker 603 has performed the previously described four tests, it outputs T*(i-2) to the pitch filter 111 of FIG. 1. Pitch tracker 603 retains the other pitch distances for calculation on the next received pitch instance from distance detector 602.

Figure 8:
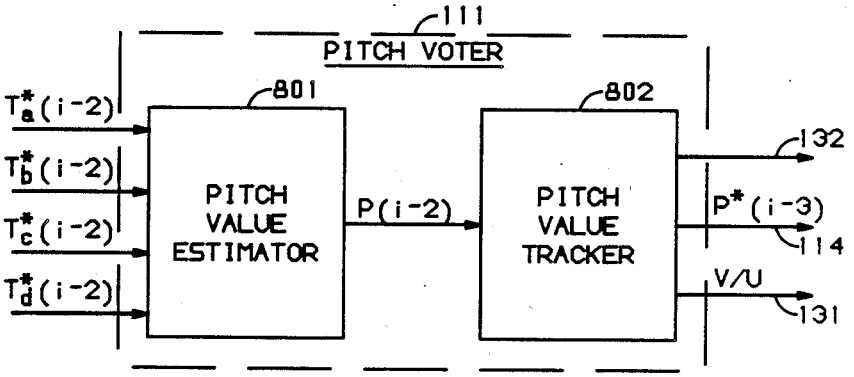
FIG. 8 illustrates, in block diagram form, pitch voter 111 of FIG. 1.

FIG. 8 illustrates, in greater detail, pitch filter 111 of FIG. 1. Pitch value estimator 801 is responsive to the outputs of pitch detectors 107 through 110 to make an initial estimate of what the pitch is for two frames earlier, P(i-2), and pitch value tracker 802 is responsive to the output of pitch value estimator 801 to constrain the final pitch value for the third previous frame, P(i-3), to be consistent from frame to frame. In addition to determining and transmitting the pitch value, pitch filter 111 generates and transmits the v/u signal and the location of the first pulse at the start of a voiced region.

Consider now, in greater detail, the functions performed by pitch value estimator 801. In general, if all of the four pitch distance estimates values received by pitch value estimator 801 are non-zero, indicating a voiced frame, then the lowest and highest estimates are discarded, and P(i-2) is set equal to the arithmetic average of the two remaining estimates. Similarly, if three of the pitch distance estimate values are non-zero, the highest and lowest estimates are discarded, and pitch value estimator 801 sets P(i-2) equal to the remaining non-zero estimate. If only two of the estimates are non-zero, pitch value estimator 801 sets P(i-2) equal to the arithmetic average of the two pitch distance estimated values only if the two values are close to within the pitch threshold A. If the two values are not close to within the pitch threshold A, then pitch value estimator 801 sets P(i-2) equal to zero. This determination indicates that frame i-2 is unvoiced, although some individual detectors determined, incorrectly, some periodicity. If only one of the four pitch distance estimate values is non-zero, pitch value estimator 801 sets P(i-2) equal to the non-zero value. In this case, it is left to pitch value tracker 802 to check the validity of this pitch distance estimate value so as to make it consistent with the previous pitch estimate. If all of the pitch distance estimate values are equal to zero, then, pitch value estimator 801 sets P(i-2) equal to zero.

Pitch value tracker 802 is now considered in greater detail. Pitch value tracker 802 is responsive to the output of pitch value estimator 801 to produce a pitch value estimate for the third previous frame, P*(i-3), and makes this estimate based on P(i-2) and P(i-4). The pitch value P*(i-3) is chosen so as to be consistent from frame to frame.

The first thing checked is a sequence of frames having the form: voiced-unvoiced-voiced, unvoiced-voiced-unvoiced, or voiced-voiced-unvoiced. If the first sequence occurs as is indicated by P(i-4) and P(i-2) being non-zero and P(i-3) is zero, then the final pitch value, P*(i-3), is set equal to the arithmetic average of P(i-4) and P(i-2) by pitch value tracker 802. If the second sequence occurs, then the final pitch value, P*(i-3), is set equal to zero. With respect to the third sequence, the latter pitch tracker is responsive to P(i-4) and P(i-3) being non-zero and P(i-2) being zero to set P*(i-3) to the arithmetic average of P(i-3) and P(i-4), as long as P(i-3) and P(i-4) are close to within the pitch threshold A. Pitch tracker 802 is responsive to $$|P(i\text{-}4)-P(i\text{-}3)| \leqq A,$$

to perform the following operation $$P^*(i-3) = \frac{P(i-4)+P(i-3)}{2}.$$

if pitch value tracker 802 determines that P(i-3) and P(i-4) do not meet the above condition (that is, they are not close to within the pitch threshold A), then, pitch value tracker 802 sets P*(i-3) equal to the value of P(i-4).

In addition to the previously described operations, pitch value tracker 802 also performs operations designed to smooth the pitch value estimates for certain types of voiced-voiced-voiced frame sequences. Three types of frame sequences occur where these smoothing operations are performed. The first sequence is when the following is true $$|P(i\text{-}4)-P(i\text{-}2)| \leqq A,$$

and $$|P(i\text{-}4)-P(i\text{-}3)| > A.$$

When the above conditions are true, pitch value tracker 802 performs a smoothing operation by setting $$P^*(i-3) = \frac{P(i-4)+P(i-2)}{2}.$$

The second set of conditions occurs when $$|P(i\text{-}4)-P(i\text{-}2)| > A,$$

and $$|P(i\text{-}4)-P(i\text{-}3)| \leqq A.$$

When this second set of conditions is true, pitch value tracker 802 sets $$P^*(i-3) = \frac{P(i-4)+P(i-3)}{2}.$$

The third and final set of conditions is defined as $$|P(i\text{-}4)-P(i\text{-}2)| > A,$$

and $$|P(i\text{-}4)-P(i\text{-}3)| > A.$$

For this final set of conditions occur, pitch value tracker 802 sets $$P^*(i\text{-}3)=P(i\text{-}4).$$

Figure 9:
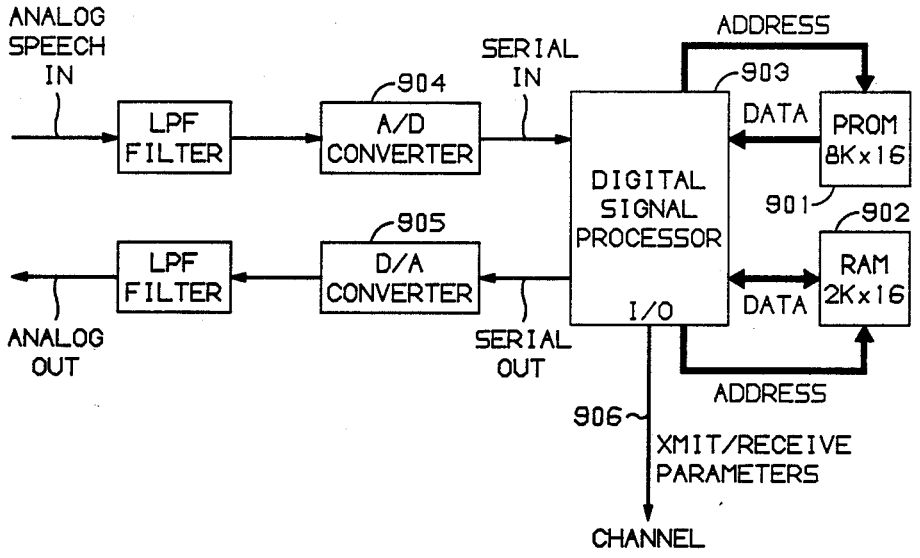
FIG. 9 illustrates a digital signal processor implementation of FIGS. 1 and 2.

FIG. 9 illustrates an embodiment of the analyzer and synthesizers of FIGS. 1 and 2, respectively, implemented using a digital signal processor. Digital signal processor 903 may advantageously be the Texas Instruments TMS320-20. To implement the functions illustrated in FIGS. 1 and 2 as illustrated in flow diagram form in FIGS. 10 through 15 is stored in PROM 901 of FIG. 9. The combination analyzer/synthesizer of FIG. 9 is connected to a similar unit via channel 906, and voice conversations are communicated using these two analyzer/synthesizer units. RAM 902 is used for storage of various types of information including the storage of individual parameters for each pitch detector illustrated in FIG. 1. The pitch detectors are implemented using common program instruction stored in PROM 901. The analyzer/synthesizer of FIG. 9 uses analog-to-digital converter 904 to digitize incoming speech and digital-to-analog converter 905 to output an analog representation of digital signals received via channel 906.

Figure 10:
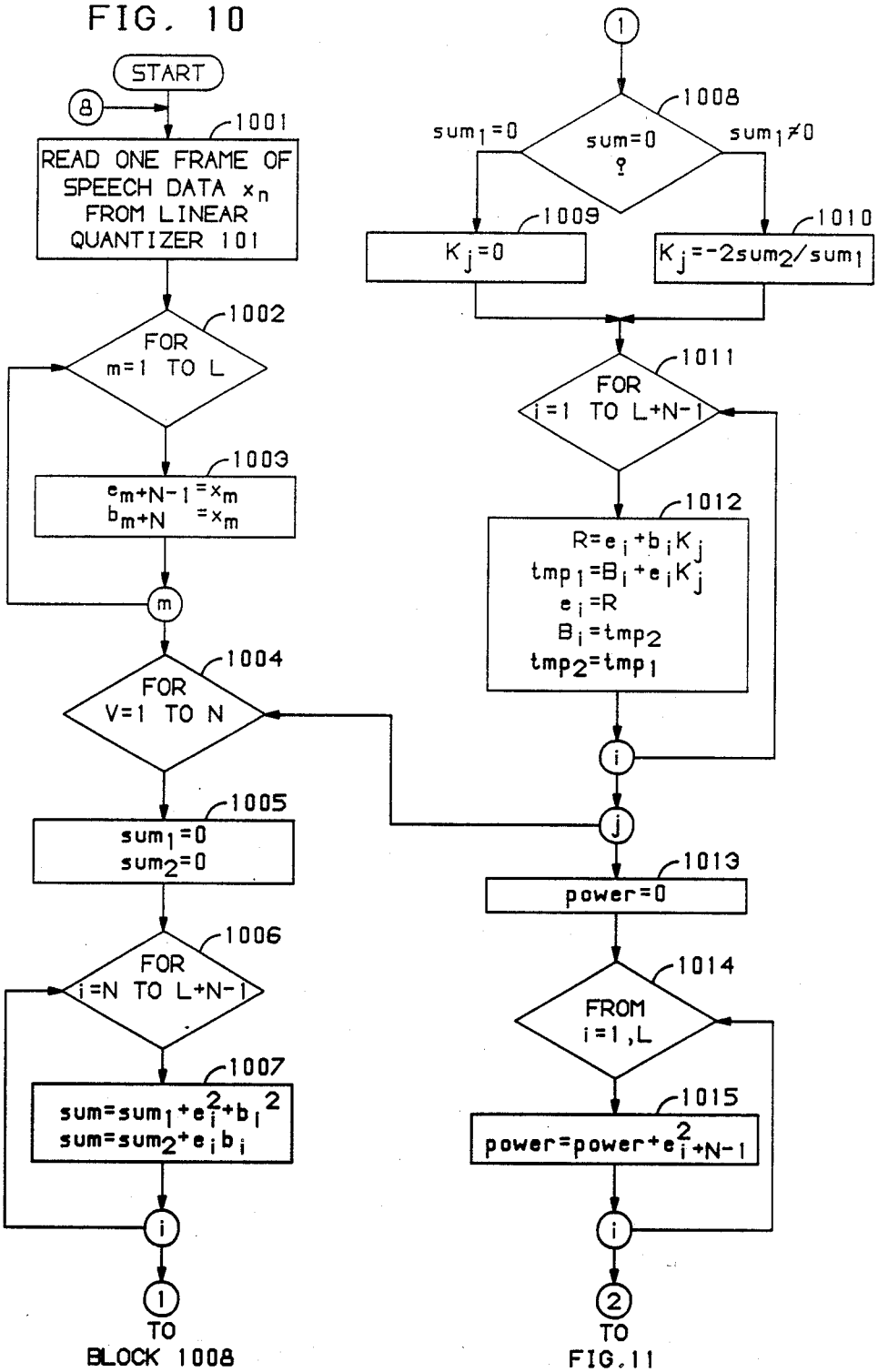
FIGS. 10 through 14 illustrate, in flow chart form, a program for controlling the digital signal processor of FIG. 9 to allow implementation of the analyzer circuit of FIG. 1.

FIG. 10 illustrates a software implementation of LPC coder and filter 102 of FIG. 1 for execution by digital signal processor 903. The program illustrated in flow chart form on FIG. 10 implements the Burg algorithm as described in the book entitled *Digital Processing of Speech Signals*, L. Rabiner, Prentice-Hall, (New Jersey 1978), p. 416, by execution of blocks 1001 through 1012. This algorithm calculates the LPC coefficients and the residual e(n) for each frame. After the latter has been determined, the lower for each frame is calculated from the residual samples by blocks 1013, 1014, and 1015.

Figure 11:
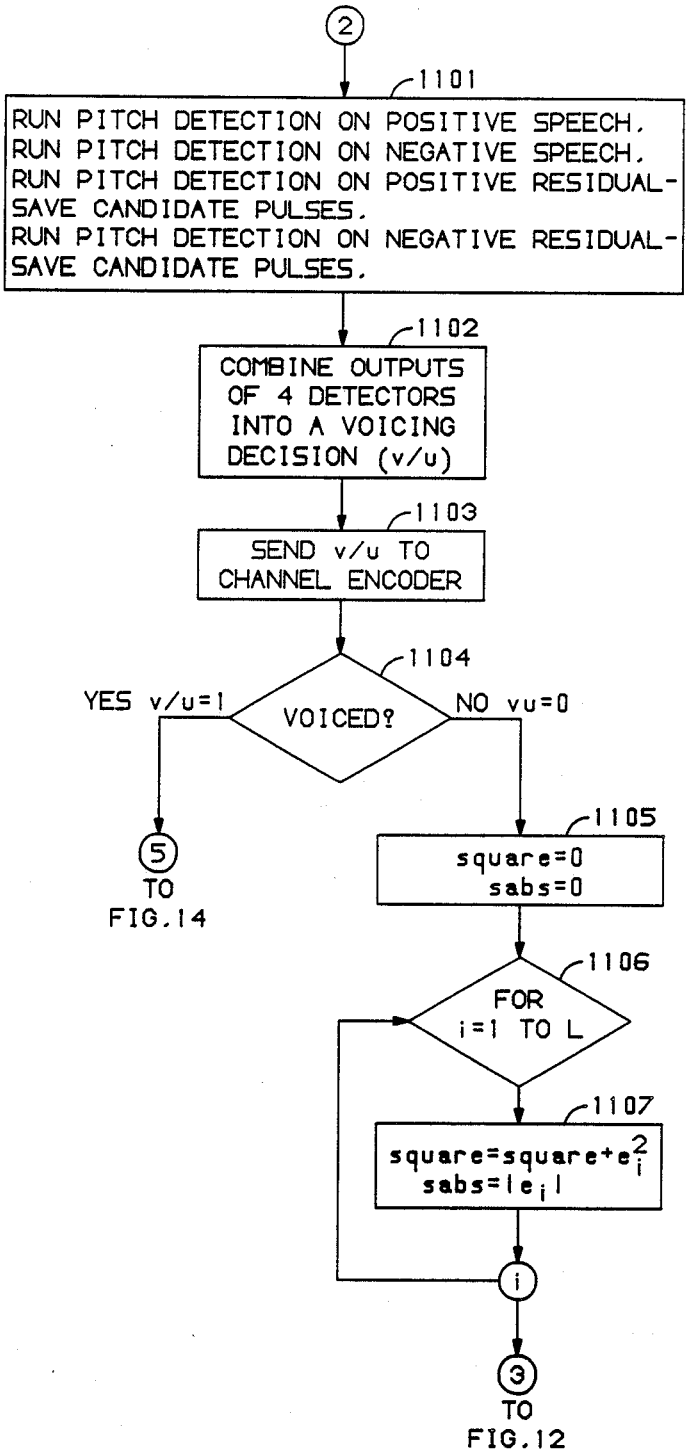
Figure 14:
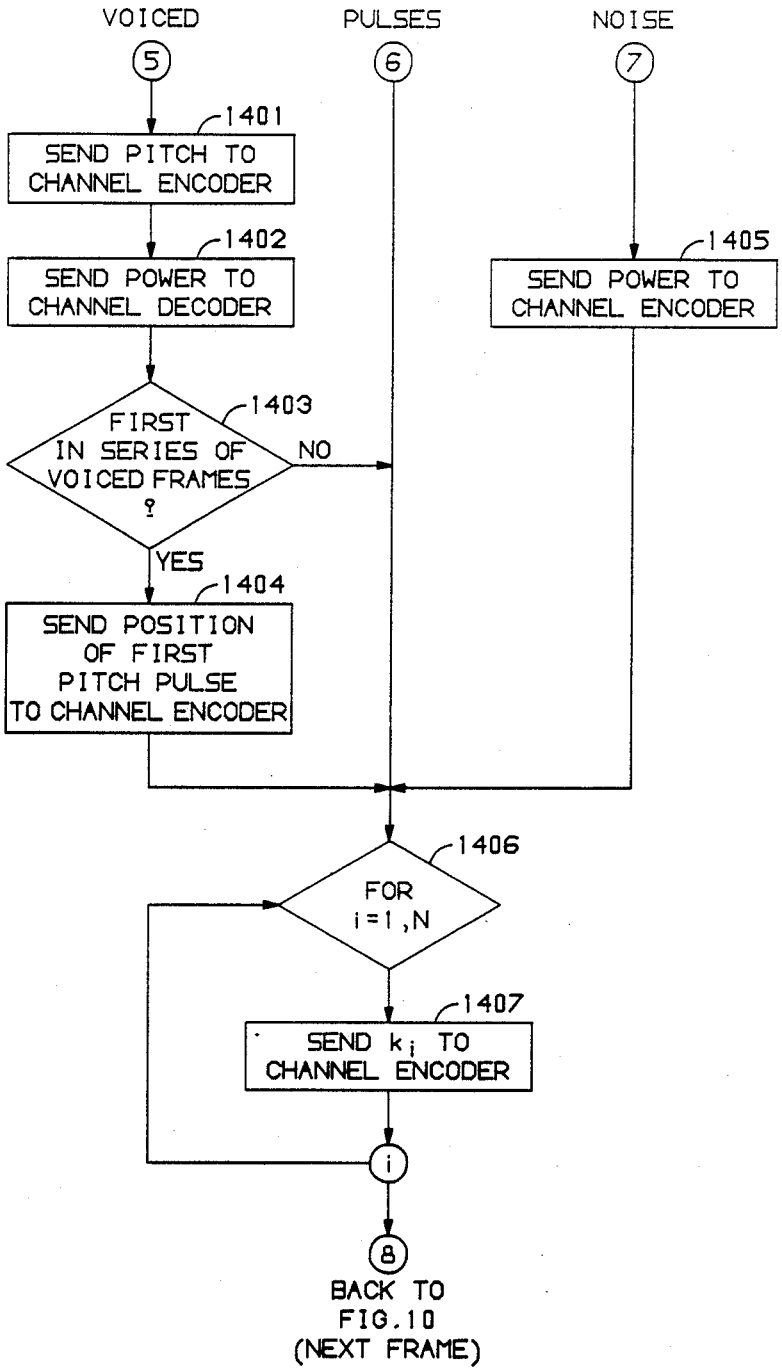

Next, the pitch detectors 107 through 110 of FIG. 1 are implemented by block 1101 of FIG. 11. Block 1101 performs the pitch detection on positive and negative speech samples and positive and negative residual samples by utilizing a common set of program instructions each having separate storage parameters in RAM 902 of FIG. 9. For the residual samples, the candidate pulses determined during pitch detection are saved for later possible use as pulse excitation. After the pitch detection has been performed, the functions of pitch voter 111 of FIG. 1 are then implemented by blocks 1102 and 1103. The v/u bit is set by block 1102. The latter bit is examined by decision block 1104. If the v/u bit has been set to a "1" indicating that the speech frame is a voiced frame, then blocks 1401 through 1404 and 1406 and 1047 of FIG. 14 are executed. Blocks 1401 and 1402 send the pitch and power information to the channel encoder, respectively. Decision block 1403 determines whether the voice frame is the first in a series of voice frames; and, if it is, block 1404 transmits to the channel encoder the location of the first pitch pulse. This information is utilized by the synthesizer to properly utilize the pitch information. Next, blocks 1406 and 1407 communicate the LPC coefficients $k_i$ to the channel encoder. The channel encoder then transmits the received information to the synthesizer via the channel in byte form utilizing well-known techniques.

If the v/u bit is set to a "0", then decision block 1104 transfers control to blocks 1105 through 1201. The latter blocks perform the calculations necessary to determine the left and right sides of equation 2. Once these calculations have been performed, the decision of whether to utilize pulse excitation or noise excitation is made by decision block 1202 that is implementing the final step of equation 2. If the determination is made that noise excitation is to be utilized, then control is passed to block 1203 of FIG. 12 and blocks 1405 through 1407 of FIG. 14. These blocks prepare and transfer the information to the channel encoder for the utilization of noise excitation by the synthesizer.

Figure 12:
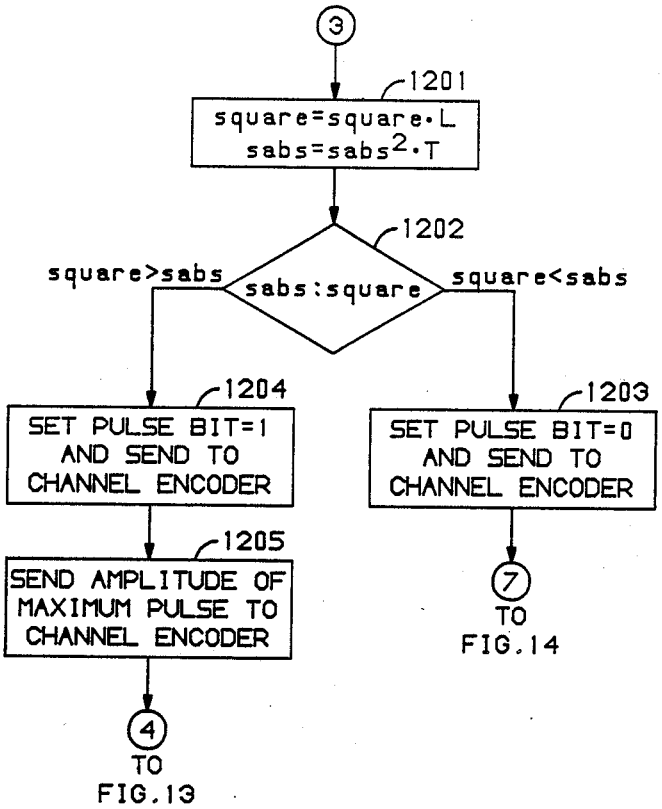
Figure 13:
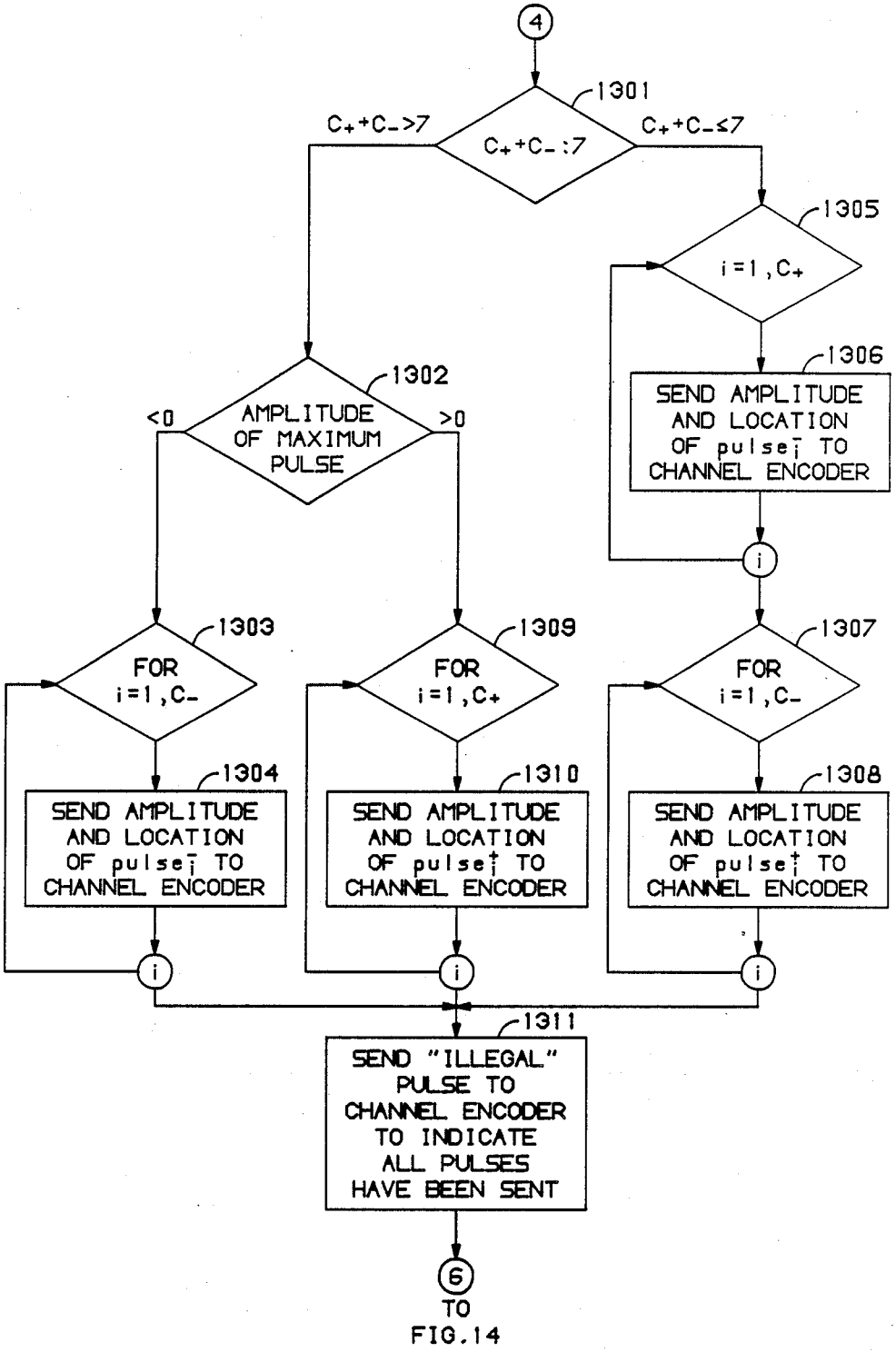

If the decision is made to utilize pulse excitation, then decision block 1202 passes control to blocks 1204 and 1205 of FIG. 12. The execution of block 1204 causes a "1" to be transmitted to the channel encoder indicating that pulse excitation is to be performed, and the execution of block 1205 causes the amplitude of the maximum candidate pulse to be transmitted to the channel encoder. The maximum candidate pulse is determined by the pitch detectors implemented by block 1101 of FIG. 11. After the latter information has been transferred to the channel encoder, decision block 1301 of FIG. 13 is executed. The purpose of decision block 1301 is to determine which of the candidate pulses found by block 1101 of FIG. 11 are to be transferred to the synthesizer. If the total number of candidate pulses found by the residual pitch detectors is less than or equal to 7, then all of the candidate pulses are transferred. If the number of candidate pulses found is greater than 7, then the candidate pulses from the pitch detector that had the largest amplitude candidate pulse are transferred to the channel. If the total number of pulses is greater than 7, then decision block 1302 is executed which determines whether the candidate pulse of the largest amplitude existed in the samples from the negative or positive residual samples. If the maximum pulse amplitude exists in the negative residual samples, then blocks 1303 and 1304 are executed that results in the transfer of the candidate pulses from the T-negative residual samples to the channel encoder. If the determination is made by decision block 1302 that the maximum amplitude candidate pulse is in the positive residual samples, then blocks 1309 and 1310 are executed that results in the candidate pulses from the positive residual samples to be transmitted to the channel encoder. The information transferred by block 1304 is the amplitude and the location of each candidate pulse. The amplitude information is relative to the amplitude of the candidate pulse of maximum amplitude which was transferred to the channel encoder by block 1205.

If the determination by decision block 1301 is that the total number of candidate pulses in both the negative and positive residual samples is less than or equal to 7, then blocks 1305, 1306, 1307, and 1308 are executed which results in all of the candidate pulses for both the positive and negative residual samples to be transferred to the channel encoder.

After the above operations have been performed, block 1311 is executed to indicate to the channel encoder that all of the pulses have been communicated. After the execution of block 1311, blocks 1406 and 1407 of FIG. 14 are executed to transfer the LPC coefficients to the channel encoder. Once either the pitch, noise, or pulse excitation information, along with the LPC coefficients and power information has been transferred to the channel encoder, the process is repeated for the next frame.

Figure 15:
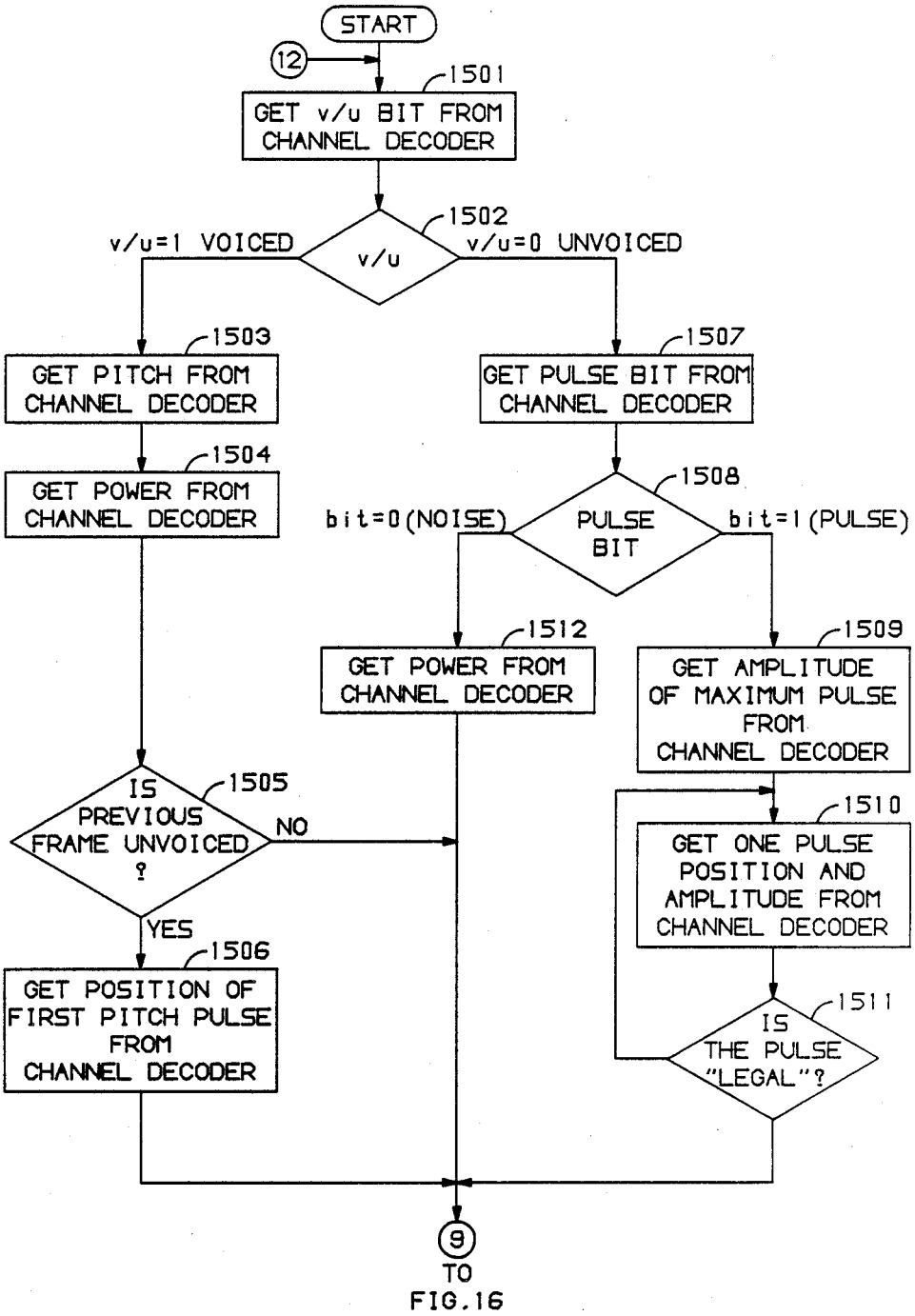
FIGS. 15 through 17 illustrate, in flow chart form, a program to control the execution of the digital signal processor of FIG. 9 to allow implementation of the synthesizer of FIG. 2.
Figure 16:
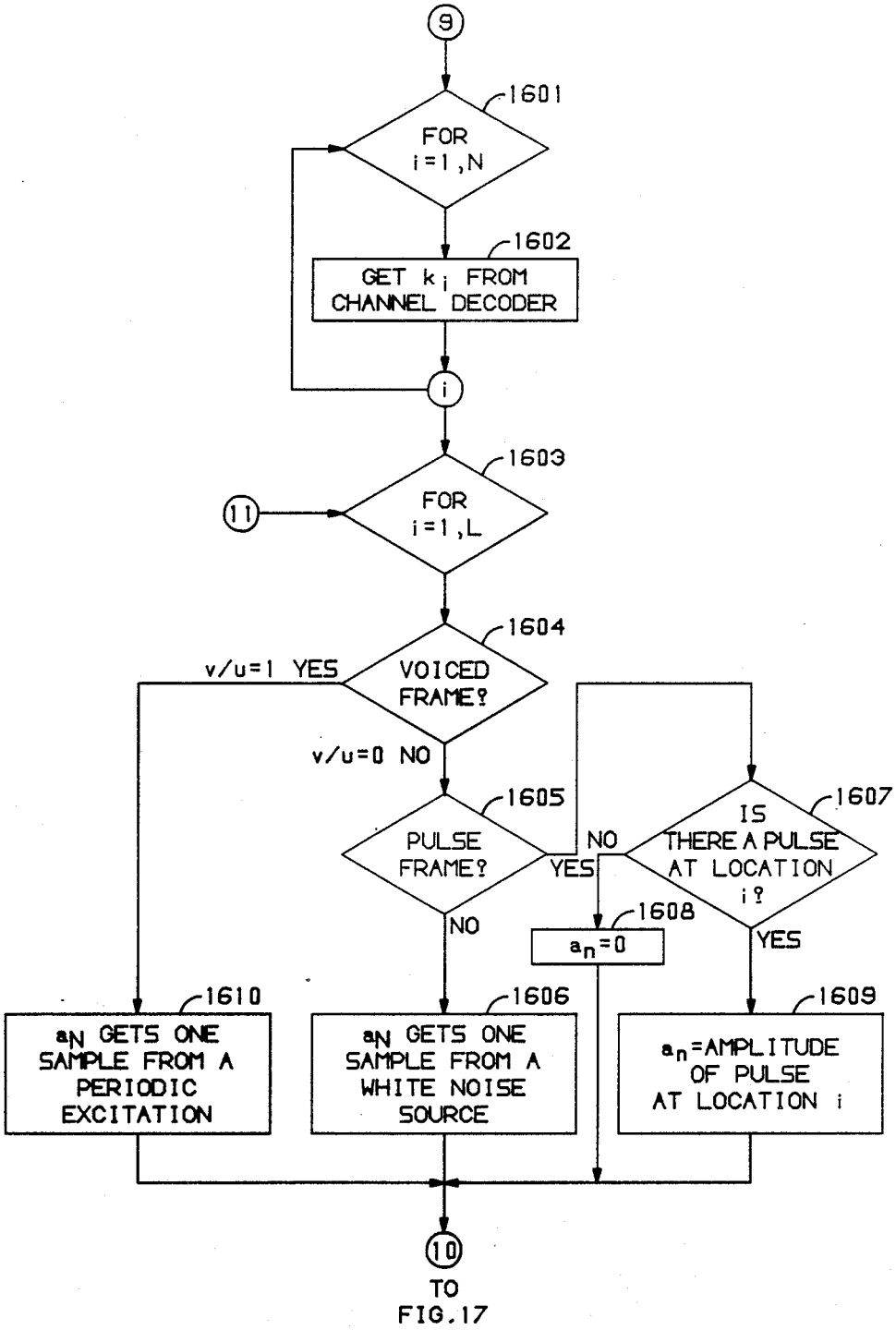
Figure 17:
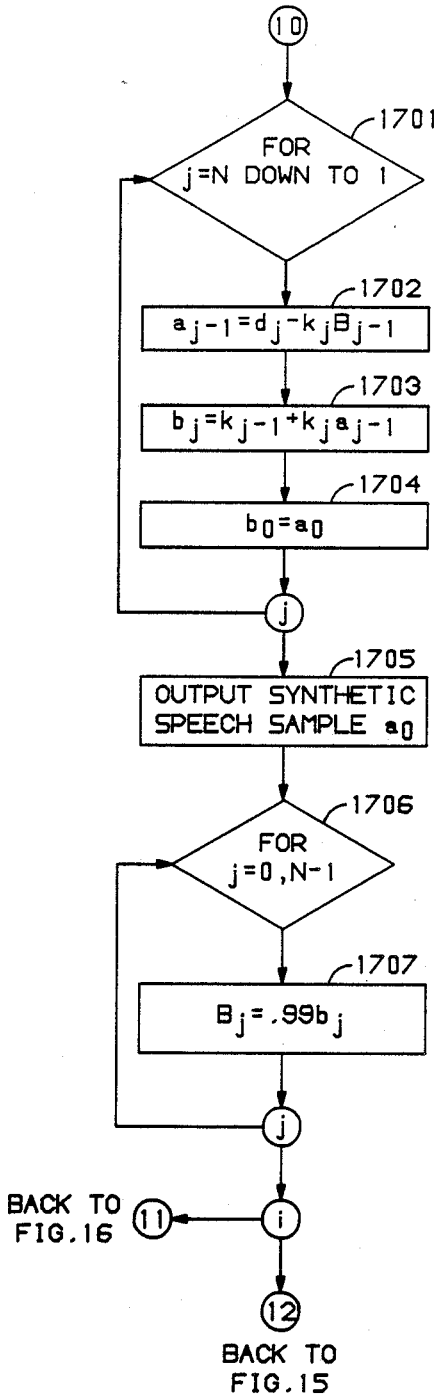

The program for digital signal processor 903 of FIG. 9 to implement the synthesizer of FIG. 2 is illustrated in FIGS. 15, 16, and 17. The program steps illustrated in flow chart on FIG. 15 determine the type of excitation that is to be utilized to drive the program instructions that implement the synthesis filter 207. The program steps illustrated by FIG. 15 determines the frame type and reads certain parameters. Block 1501 first obtains the v/u bit from the channel decoder, and decision block 1502, that is implementing selector 206 of FIG. 2, determines whether the v/u bit is a "1" or a "0" indicating voiced or unvoiced speech information, respectively. If voiced information is indicated, then blocks 1503 and 1504 are executed to obtain the pitch and power information from the channel decoder. After the latter has been obtained, a check is made to determine whether or not this is the first frame of a voiced region by execution of decision block 1505. If it is the first frame of a voiced region, then block 1506 is executed in order to obtain the position of the first pitch pulse within the voiced frame.

If the determination is that the information is unvoiced, then block 1507 is implemented. The latter block obtains the pulse bit from the channel decoder. Decision block 1508 on the basis of whether the pulse bit is a "1" or a "0" implements the programmed instructions to utilize pulse excitation or noise excitation, respectively, and is implementing selector 205 of FIG. 2. If the pulse bit is a "0", which indicates noise excitation, then the power is obtained from the channel decoder by block 1512. If the pulse bit is a "1", indicating pulse excitation, blocks 1509 through 1511 are executed to get the first pulse position of a candidate pulse to be used for the pulse excitation.

After the first frame type pulse is determined, the programmed steps illustrated in flow chart form by FIGS. 16 and 17 are executed. Blocks 1603 through 1610 determine the pulses to be utilized for excitation and blocks 1701 through 1707 implement the synthesis filter. Decision block 1603 determines when a frame of speech has been entirely synthesized. Decision block 1604 once again, determines whether a frame is voiced or unvoiced. If a voiced frame, then block 1610 is executed to determine the next pulse for pitch excitation, and the synthesis filter programmed instructions are executed after that.

If the frame is unvoiced, then decision block 1605 is executed to determine whether to use noise or pulse excitation. If noise excitation is to be used, then decision block 1606 is used to obtain the pulse to be utilized by the synthesis filter programmed instructions. If pulse excitation is to be utilized, then blocks 1607 through 1609 are executed to determine the proper pulse excitation pulse to be utilized.

The synthesis filter is implemented by blocks 1701 through 1707 utilizing well-known LPC synthesis techniques. After an entire frame of speech has been synthesized, then the programmed instructions illustrated by FIGS. 16 and 17 are repeated for the next frame of speech.

Another embodiment of our invention is given by instructions written in the C programming language that are given in Microfiche Appendices A and B. The analyzer portion of an analyzer/synthesizer unit is defined by the program instructions in Microfiche Appendix A, and the synthesizer is defined by the program instructions in Microfiche Appendix B. These programs are designed to be utilized with a Digital Equipment Corp.'s VAX 11/780-5 computer system with suitable digital-to-analog and analog-to-digital converter peripherals or a similar system.

It is to be understood that the above-described embodiment is merely illustrative of the principles of the invention and that other arrangements may be devised by those skilled in the art without departing from the spirit and scope of the invention.

What is claimed is:

1. A processing system for the analysis and synthesis of human speech comprising:

means for storing a plurality of speech frames each having a predetermined number of evenly spaced samples of instantaneous amplitudes of said speech;

means for calculating a set of speech parameter signals defining a vocal tract for each speech frame;

means for designating a first subset of said plurality of speech frames as voiced and a second subset of said plurality of speech frames as unvoiced;

means for generating pitch type excitation information for each frame of said first subset of said plurality of speech frames;

means for producing a plurality of other types of excitation information for each frame of said second subset of said plurality of speech frames;

means responsive to said designating means designating each frame of said first subset of said plurality of speech frames for combining said pitch type excitation information and said set of said speech parameter signals;

said combining means further comprises means responsive to said designating means designating each frame of said second subset of said plurality of speech frames for selecting one of said other types of excitation information and means for combining the selected one of said other types of excitation information with the set of said speech parameter signals; and means for communicating said combined excitation information including said pitch type excitation information and the set of said speech parameter signals for each frame of said first subset of said plurality of speech frames and said combined excitation information including the selected one of said other types of excitation information and the set of said speech parameter signals for each of frame of said second subset of said plurality of speech frames.

2. The system of claim 1 wherein said producing means comprises means for determining pulses from said speech samples for each frame of said second subset of said plurality of speech frames to provide pulse type excitation.

3. The system of claim 2 wherein said determining means comprises means for calculating residual samples from said speech samples for each frame of said second subset of said plurality of speech frames; and means for locating a subset of pulses of said residual samples having maximum amplitudes for each frame of said second subset of said plurality of speech frames.

4. The system of claim 3 wherein said selecting means comprises means for calculating a variance of the residual samples for each frame of said second subset of said plurality of speech frames;

means for rectifying said residual samples;

means for calculating the means amplitude of the rectified residual samples;

means for calculating a square of the means amplitude of said rectified residual samples in each frame of said second subset of said plurality of speech frames;

means for comparing the calculated variance of the residual to the calculated square of the mean amplitude of the rectified residual for each frame of said second subset of said plurality of speech frames; and means for designating said pulse type excitation information to be selected upon the comparison being greater than a predetermined threshold.

5. The system of claim 3 wherein said selecting means comprises means for squaring each residual sample of each of said frames;

means for summing together all of the squared residual samples for each of said frames;

means for multiplying said predetermined number of samples in a frame by the sum of said squared residual samples for each of said frames to generate a value;

means for obtaining an absolute value for each of said residual samples in each of said frames;

means for summing all of the absolute residual sample values for each of said frames; and means for squaring the summed absolute residual sample values for each of said frames to generate another value;

means for comparing said value to said other value for each of said frames; and means for designating said pulse type excitation information to be selected upon said comparison being greater than a predetermined threshold.

6. The system of claim 5 wherein said means for calculating said set of speech parameter signals comprises means for calculating a set of linear predictive coded parameter for each of said frames.

7. The system of claim 6 wherein said means for generating said pitch type excitation information comprises:

a plurality of identical means each utilizing an individual predetermined portion of said speech samples of each of said frames for estimating an individual pitch value for each of said frames; and means responsive to each of said estimating means estimating each of said estimated individual pitch values for determining a final pitch value for each of said frames.

8. The system of claim 7 wherein said final pitch value determining means comprises:

means for calculating said final pitch value from said estimated individual pitch values each received from an individual one of said estimating means for each of said frames; and means for constraining said final pitch value so that the calculated final pitch value for each of said frames is consistent with the calculated pitch values from previous ones of said frames to said each of said frames.

9. The system of claim 5 further comprises means for receiving said communicated combined excitation information and said set of speech parameter signals for each of said frames;

means for synthesizing each frame of speech utilizing said set of speech parameter signals and said pitch excitation information upon said pitch excitation information being communicated; and said synthesizing means further utilizing said set of speech parameter signals and one of said plurality of other types of excitation information to synthesize each frame of speech utilizing said one of said other types of excitation information upon said other types of excitation information being communicated.

10. The system of claim 9 wherein said synthesizing means further comprises means for generating an unvoiced type signal upon said other types of excitation information being communicated;

means for generating a pulse type signal upon said pulse type excitation information being communicated;

means responsive to said unvoiced type signal and the absence of said pulse type signal for generating noise type excitation information; and means responsive to said pulse type signal for selecting said pulse type excitation information.

11. A processing system for the analysis and synthesis of human speech comprising:

means for storing a plurality of speech frames each having a predetermined number of evenly spaced samples of instantaneous amplitudes of said speech;

means for calculating a set of speech parameter signals defining a vocal tract for each speech frame;

means for detecting speech resulting from a fundamental frequency and a noise-like source for each speech frame;

means for forming pitch excitation information for each frame upon the frame containing said fundamental frequency;

means for forming excitation information to indicate that noise excitation information is to be used to synthesize each of said frames upon speech of the frame resulting from said noise-like source in the human larynx;

means for forming excitation information from another excitation source upon an absence of said fundamental frequency and said noise-like source; and means for combining the formed excitation information and the set of parameter signals of each frame for communication.

12. The system of claim 1 wherein the means for forming said pitch excitation information comprises:

means for detecting the presence of said fundamental frequency in the samples of said frames;

means for calculating said pitch in each of said frames; and means for forming said calculated pitch into said excitation information upon said detecting means determining the presence of said fundamental frequency.

13. The system of claim 12 wherein said means for forming said excitation information from said other excitation source comprises means for determining pulses from said speech samples for each of said frames to provide the excitation information from said other excitation source.

14. The system of claim 13 wherein said determining means comprises means for calculating residual samples from said speech samples for each of said frames; and means for locating a subset of pulses of said residual samples having maximum amplitudes for each of said frames.

15. The system of claim 14 wherein said means for forming said excitation information from said other source further comprises means for calculating a variance of said residual samples for each of said frames;

means for rectifying said residual samples;

means for calculating the mean amplitude of the rectified residual samples;

means for calculating a square of the mean amplitude of said rectified residual samples in each frame;

means for comparing the calculated variance of the residual to the calculated square of the mean amplitude of the rectified residual for each of said frames; and means for selecting said excitation information from said other source to be said pulse type information upon the comparison being greater than a predetermined threshold.

16. The system of claim 15 wherein said means for calculating said pitch in each of said frames comprises:

a plurality of identical means each utilizing an individual predetermined portion of said speech samples of each of said frames for estimating an individual pitch value for each of said frames; and means utilizing each of said estimated individual pitch values from each of said estimating means for determining a final pitch value for each of said frames.

17. The system of claim 16 wherein said means for determining said final pitch value comprises:

means for calculating said final pitch value from said estimated individual pitch values each received from an individual one of said estimating means for each of said frames; and means for constraining said final pitch value so that the calculated pitch value for each of said frames is consistent with the calculated pitch values from previous ones of said frames to said each of said frames.

18. The system of claim 11 wherein said means for calculating said set of speech parameter signals comprises means for calculating a set of linear predictive coded parameters for each of said frames.

19. The system of claim 11 further comprises means for receiving the information communicated from said combining means for each of said frames;

means for synthesizing each frame of speech utilizing said set of speech parameter signals and said pitch excitation information upon said pitch excitation information being communicated;

said synthesizing means comprising means for generating noise excitation information;

said synthesizing means further utilizing said set of speech parameter signal and said generated noise excitation information to synthesize each frame of speech upon excitation information in said received information indicating the use of said noise excitation information; and said synthesizing means further utilizing said set of speech parameter signals and one of said plurality of other types of excitation information to synthesize each frame of speech utilizing said one of said other type of excitation information upon said other types of excitation information being communicated.

20. The system of claim 19 wherein said synthesizing means further comprises means for generating an unvoiced type signal upon said other types of excitation information being communicated;

means for generating a pulse type signal upon said pulse type excitation information being communicated;

means responsive to said unvoiced type signal and absence of said pulse type signal for generating noise type excitation information; and means responsive to said pulse type signal for selecting said pulse type excitation information.

21. A method for analyzing and synthesizing human speech with a system comprising a quantizer for converting the speech into frames of digital samples and a digital signal processor responsive to a plurality of program instructions to analyze and synthesize the speech, said method comprising the steps of:

storing a plurality of speech frames each having a predetermined number of evenly spaced samples of instantaneous amplitudes of said speech;

calculating a set of speech parameter signals defining a vocal tract for each speech frame;

designating a first subset of said plurality of speech frames as voiced and a second subset of said plurality of speech frames as unvoiced;

generating pitch type excitation information for each frame of said first subset of said plurality of speech frames;

producing a plurality of other types of excitation information for each frame of said second subset of said plurality of speech frames;

combining said pitch type excitation information and said set of speech parameter signals for each frame of said first subset of said plurality of speech frames designated as voiced;

selecting one of said other types of excitation for each frame of said second subset of said plurality of speech frames;

combining the selected one of said other type of excitation information with the set of said speech parameters for each frame of said second subset of said plurality of speech frames; and communicating said combined excitation information including said pitch-type excitation information and the set of said speech parameter signals for each frame of said first subset of said plurality of speech frames and said combined excitation information including the selected one of said other types of excitation information and the set of said speech parameter signals for each frame of said second subset of said plurality of speech frames.

22. The method of claim 21 wherein said producing step comprises the steps of calculating residual samples from said speech samples for each frame of said second subset of said plurality of speech frames; and determining pulses from said residual samples for each frame of said second subset of said plurality of speech frames to provide pulse type excitation.

23. The method of claim 22 wherein said determining step comprises the step of locating a subset of pulses of said residual samples having maximum amplitudes for each frame of said second subset of said plurality of speech frames.

24. The method of claim 23 wherein said selecting step comprises the step of calculating a variance of the residual samples for each frame of said second subset of said plurality of speech frames;

rectifying said residual samples;

calculating the means amplitude of the rectified residual samples;

calculating a square of the means amplitude of the rectified residual samples in each frame of said second subset of said plurality of speech frames;

comparing the calculating variance and the calculated square of the means amplitude for each frame of said second subset of said plurality of speech frames; and designating said pulse type information to be selected upon the comparison being greater than a predetermined threshold.

* * * * *